US006927547B2

(12) United States Patent
Walko, Jr. et al.

(10) Patent No.: US 6,927,547 B2
(45) Date of Patent: Aug. 9, 2005

(54) SYSTEM BRIDGE AND TIMECLOCK FOR RF CONTROLLED LIGHTING SYSTEMS

(75) Inventors: Robert Francis Walko, Jr., Macungie, PA (US); Jon Michael Keagy, Perkasie, PA (US); Jason Douglass Craze, Allentown, PA (US); Glen Andrew Kruse, Lansdale, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 10/681,062

(22) Filed: Oct. 8, 2003

(65) Prior Publication Data

US 2005/0001557 A1 Jan. 6, 2005

Related U.S. Application Data

(60) Provisional application No. 60/477,505, filed on Jun. 10, 2003.

(51) Int. Cl.[7] ..... F21V 33/00

(52) U.S. Cl. ..... 315/316; 315/312; 340/825.72

(58) Field of Search ..... 315/291, 293–295, 315/312–318; 340/825.06, 825.69, 825.72, 527, 531, 538, 539

(56) References Cited

U.S. PATENT DOCUMENTS

| | | | | |
|---|---|---|---|---|
| 4,755,792 A | * | 7/1988 | Pezzolo et al. | 340/538 |
| 5,254,908 A | * | 10/1993 | Alt et al. | 315/312 |
| 5,331,450 A | | 7/1994 | Heep et al. | 359/135 |
| 5,886,647 A | * | 3/1999 | Badger et al. | 340/825.72 |
| 6,459,217 B1 | * | 10/2002 | Belliveau | 315/316 |
| 2003/0020595 A1 | | 1/2003 | Wacyk | 340/3.5 |

FOREIGN PATENT DOCUMENTS

| | | |
|---|---|---|
| EP | 1 251 721 A1 | 10/2003 |
| WO | WO 98/19502 | 5/1998 |

OTHER PUBLICATIONS

Vantage Radio Link—http://www.vantagecontrols.com/—Automation and Lighting Control, May 12, 2004, 2 pages.
Lutron Home works—http://www.lutron.com/resi/—Introduction to HomeWorks Interactive, May 12, 2004, 3 pages.
Lightolier—http://www.lightolier.com/– Welcome to Lightolier, May 12, 2004, 3 pages.
Lightolier—http://www.lightolier.com/– Welcome to Lightoiler, May 12, 2004, 3 pages.
GE Smart—http://www.ge–securitypro.com/gesmart/index.cfm—GE Smart Connection Center, May 12, 2004, 2 pages.
Lighting Control and Automation Systems by LiteTouch—http://www.litetouch.com/main.html , May 12, 2004, 2 pages.
Sensus—http://www.ims.invensys.com/newdesign.asp—Sensus Metering Systems, May 12, 2004, 1 page.
Creston Remote Control Systems http://www.tierney-bros.com/accessories_peripherals/control_systems.htm, May 12, 2004,8 pages.
Centralite Systems—http://www.centralite.com/—Centralized Lighting and Home Control Systems, May 12, 2004, 3 pages.

(Continued)

*Primary Examiner*—Wilson Lee
(74) *Attorney, Agent, or Firm*—Woodcock Washburn LLP

(57) ABSTRACT

A method for operatively interconnecting a first and second lighting control subnet is disclosed. In the method, a link claim is transmitted to the first and second lighting control subnets from a bridge. The link claim directs the first and second lighting control subnets to wait for a lighting control command, which is transmitted to the lighting control command to the first lighting control subnet. A random wait time is assigned to the first lighting control subnet and a maximum random wait time is assigned to the second lighting control subnet. Finally, an acknowledgement is received from the first lighting control subnet.

37 Claims, 11 Drawing Sheets-

OTHER PUBLICATIONS

Intermatic—http://www.intermatic.com/—Intermatic Manufacturing Quality Products Since 1891, May 12, 2004, 1 page.
Tork—http://www.tork.com/—Tork Spec Grade Energy Controls And Signals, May 12, 2004, 1 page.
JDS—http://www.jdstechnologies.com/—JDS Technologies "The Home of Automation", May 12, 2004, 5 pages.
Powerline Control Systems—http://www.pcslighting.com/ –PCS Powerline Control Systems, May 12, 2004, 2 pages.
Home Automation Inc. (HAI)—http://www.homeauto.com/—HAI Automation Simplified, May 12, 2004, 3 pages.
Home Automated Living (HAL2000) –http://www.automatedliving.com/default.htm*Control Your Home by Voice from Anywhere*, May 12, 2004, 2 pages.
Intellitouch—http://www.pentairpool.com/pool_products/controls/intellitouch.htm –Intellitouch* Pool And Spa Control System, May 12, 2004, 1 page.
Homeseer—http://www.homeseer.com/ –Welcome to HomeSeer Technologies LLC, May 12, 2004, 2 pages.
CorAccess—http://www.coraccess.com/—CorAccess Enhance the Experience, May 12, 2004, 2 pages.
i–touch—http://www.itouch.ws/home.html—i–touchHome, May 12, 2004, 1 page.
Destiny Networks—http://www.destinynetworks.com/, "Home Technology to Simplify Your Life", May 12, 2004, 1 page.
Sylvania—http://www.sylvania.com/—Osram Sylvania, May 12, 2004, 3 pages.
Lutron GRX–PRG www.lutron.com/grafikeye/specs/grx–prg.pdf—GRX–PRG Programming Control Interface, May 12, 2004, 6 pages.
Lutron SOFTSWITCH48/128 http://www.lutron.com/grafikeye/specs/softswitch128.pdf Softswitch 128 System Overview, 2004, 19 pages.
PCI http://www.pcilightingcontrols.com/products.htm—PCI Lighting Control Systems, May 12, 2004, 2 pages.
Lithonia Lighting, http://www.lithonia.com/controls/Document_Library/Document%20files/MLC%20Manual%20revF.pdf—Synergy Lighting Control System with MLC Controller, Operation and Programming Manual, 76 pages.
Lehigh Dimming http://www.lehighdim.com/rs232.htm—RS232 AV Interface for Solitare and Collage, May 12, 2004, 2 pages.
Leviton D4200 http://www.colortran.com/catalog/cd4200.html—Leviton Colortran Division, May 12, 2004, 2 pages.
Lutron Digital Microwatt http://www.lutron.com/digitalmicrowatt/—Introducing the First Integrated Lighting Automation System, May 12, 2004, 1 page.
Touch–Plate Lighting Controls,http://www.touchplate.com/, May 12, 2004, 1 page.
GE TLC ProSys http://www.geindustrial.com/cwc/products?pnlid=3&id=prosys , Product Information, May 12, 2004, 1 page.
GE Intrusion and Fire Detection—http://www.geindustrial.com/ge–interlogix/intrusion_fire/index.html , May 12, 2004, 2 pages.
Stanley Works—http://www.stanleyworks.com/ , May 12, 2004, 1 page.

* cited by examiner

400

SYSTEM BRIDGE AND TIMECLOCK FOR RF CONTROLLED LIGHTING SYSTEMS

RELATED APPLICATIONS

This application claims the benefit of U.S. application Ser. No. 60/477,505, filed Jun. 10, 2003, titled System Bridging Timeclock for RF Controlled Lighting Systems.

FIELD OF THE INVENTION

The present invention relates generally to lighting control systems. More particularly, the present invention relates to interconnecting lighting control systems, where the lighting control systems are operating at the same Radio Frequency (RF). Even more particularly, the present invention relates to a device and method for such interconnection.

BACKGROUND OF THE INVENTION

Lighting applications can be implemented with a combination of predetermined lighting devices operating at predetermined light intensity levels. For example, a residential lighting application may require a variety of lighting scenarios, or "scenes." A first scene may be needed for when the residents are at home and active within the house. In such a scene, lights at various locations may be illuminated with full intensity to enable safe movement within the house. A second scene may be needed for when the residents are out of the house. For example, selected outdoor and indoor lights may be illuminated at various intensity levels for security or other reasons. Likewise, additional scenes may be configured for when the residents are on vacation, entertaining, or for any other type of activity. As the number of lighting devices and/or scenes increases, it becomes more convenient to control the lighting devices from a central location, rather than by controlling each lighting device individually.

Various systems exist that allow for the remote control of lighting devices in a lighting application. Wireless lighting control is frequently used in residential and commercial applications because of the ease and low cost of installation as compared to wired systems. Wired system have numerous shortcomings that result from the need to hard-wire lighting control devices within a lighting application. For example, retrofitting an existing building to accommodate a wired system may involve routing wires through walls and other structures, installing cable trays or conduit, and/or running wire through existing conduit. If a building into which the wired system will be installed is still in the planning phases, then accommodations for the wires need be made in the design plans for the building if the above noted retrofitting issues are to be avoided. In either case, the planning for and installation of a wired system requires effort that increases costs.

In contrast, a wireless system is often a more economical choice than hardwired lighting control systems because the need to install and connect wiring, which is particularly problematic in existing buildings, is largely eliminated. Instead of having to plan for the installation of lighting control devices during the design of a building, or having to retrofit an existing building, the owner or operator of the building may simply place a lighting control device wherever such device is desired. Such a device may be battery powered or may simply be connected to a power outlet. The cost savings of wireless systems is especially noticeable in older, existing buildings that would otherwise require complicated and/or cumbersome retrofitting. Wireless systems are also a preferred choice for home applications, as such applications are typically more cost-sensitive than commercial applications.

One way to implement a wireless lighting control system having wireless lighting control devices is to enable such devices to communicate with each other by way of Radio Frequency (RF) transmissions. An example of such a RF system is the RadioRA® system manufactured by Lutron Electronics Co., of Coopersburg, Pa. In the RadioRA® protocol, all devices within a subnet—where a subnet is an individual RadioRA® system—operate on the same frequency. The use of a single frequency may be made to avoid interference with other devices within the building, to comply with FCC regulations, to reduce costs and the like. As a result, however, it is possible that the devices within a subnet may interfere with each other as a result of transmitting at the same time on the same frequency. In addition, in existing RF lighting control systems there is a limitation as to the number of devices that can be controlled on a single network. Too great a number of devices will run afoul of FCC regulations because such regulations permit transmissions of only a certain length of time on a particular frequency. Current systems, such as RadioRA®, allow for a maximum of 32 devices to be controlled.

In some applications it is necessary to use more lighting control devices than a single subnet is capable of controlling. Therefore, a second subnet may be needed to control all of the desired devices. It will be appreciated that placing two wireless lighting control systems in close proximity to each other when both are operating on the same frequency poses serious problems, particularly when a lighting scene involves both subnets. Specifically, it is possible that the individual subnets will communicate simultaneously and therefore would interfere with each other by causing messages to collide and by unnecessarily populating the RF. While the chances of interference within one subnet may be small because of the relatively short RF transmission times typically used within a single subnet, in multiple subnet scenarios the RF transmission times increase because of the greater number of devices that must receive and send RF transmissions.

For example, when two unrelated subnets are located in close proximity, each subnet runs a risk of interfering with the other. However, because each subnet is unrelated, the timing of lighting events—such as a scene—in each subnet will only occur at the same time as a coincidence. In contrast, when two or more subnets are functionally grouped together, a lighting scene that involves more than one subnet deliberately causes each effected subnet to communicate at the same time. As a result, in multiple subnet systems, the RF transmission times increase to the point that interference is likely.

Accordingly, what is needed is a method for increasing the number of devices that can be controlled by a lighting control network that uses a single RF. More particularly, what is needed is a method of linking multiple subnets that can co-exist as individual entities operating on the same RF as well as interact and communicate globally with each other without data collisions. Even more particularly, what is needed is a method for initiating programmable lighting events involving multiple subnets by way of a central control.

SUMMARY OF THE INVENTION

In view of the above shortcomings, a bridging device and method is described that provides a link between lighting networks, called subnets, which are operating on the same RF while in close proximity to each other. In an embodiment of the present invention, a bridge between two or more subnets is provided that allows each subnet to receive and transmit RF signals, or messages, to devices within the subnet or to other subnets while minimizing message collisions. An embodiment therefore permits the control of programmable lighting scenes involving lighting devices controlled by multiple subnets. Another embodiment of the present invention relates to the method of communication employed to convey information between multiple subnets.

In an embodiment of the present invention, two or more closely located subnets are provided, wherein each subnet is operating on the same RF. An embodiment enables each subnet to communicate with each other while allowing for some overlapping control between subnets by way of a master control. Accordingly, an embodiment of the present invention allows global capability through the programming and operation of, for example, phantom buttons operatively connected to the bridging device. An embodiment also minimizes the possibility of the subnets communicating simultaneously, thereby avoiding data collisions.

An embodiment of the present invention expands the number of devices that can be controlled and operated with the use of a master control panel. For example, in a RadioRA® system, the controllable devices can be increased from 32 to 64 controllable devices. In other embodiments, a different number of devices may be controlled.

BRIEF DESCRIPTION OF THE DRAWINGS

The foregoing summary, as well as the following detailed description of preferred embodiments, is better understood when read in conjunction with the appended drawings. For the purpose of illustrating the invention, there is shown in the drawings exemplary embodiments of the invention; however, the invention is not limited to the specific methods and instrumentalities disclosed. In the drawings.

DETAILED DESCRIPTION OF ILLUSTRATIVE EMBODIMENTS

An embodiment of the present invention relates to operatively interconnecting two or more RF lighting control systems that are operating in close proximity to each other on the same RF. Close proximity in such an embodiment refers to the ability of at least one device of one RF lighting control system to transmit a RF signal that may be received by at least one device of a second RF lighting control system. As may be appreciated, the RF signals used by such lighting control systems may be of any frequency that is suitable for the intended location and use of the lighting control system. For example, the frequency may be chosen to comply with FCC regulations, to avoid interference with other devices located in the area in which the lighting control system is operating, or in accordance with other considerations.

As noted above, an embodiment of the present invention relates to lighting control systems that may be employed in buildings or the like. Examples of such lighting control systems are described in U.S. Pat. Nos.: 5,982,103; 5,905,442; 5,848,054; 5,838,226 and 5,736,965; all of which are assigned to Lutron Electronics Co. and are hereby incorporated by reference in their entirety. Reference is also made to the Lutron Electronics Co. website, http://www.lutron.com, which contains more information regarding the implementation and use of the RadioRA® system. In light of the incorporated references, one of skill in the art should be familiar with methods of implementing RF lighting control systems, and therefore detailed discussion of such matters is omitted herein for clarity.

An embodiment of the present invention comprises a bridging device such as, for example, a system bridge or system bridge and timeclock (SBT) that links independent RF controlled networks, as well as a communication method employed by such bridge. In one embodiment, such devices and methods may be used to bridge, for example, two subnets of an RF lighting system. In such an embodiment, all control functions within a subnet are accomplished by RF signals between master control devices, lighting control devices, and/or, if necessary, repeaters. A master control device provides multiple control buttons that are assigned to control various lighting devices and status indicators that reflect the status of the lighting control system. The repeater, when necessary, functions to ensure that all communications sent by way of RF signals for the purpose of controlling a device will be received by all devices. In one embodiment incorporating a RadioRA® system, the lighting control devices communicate with each other by way of a RF such as, for example, 390, 418 or 434 MHz.

Figure 1:
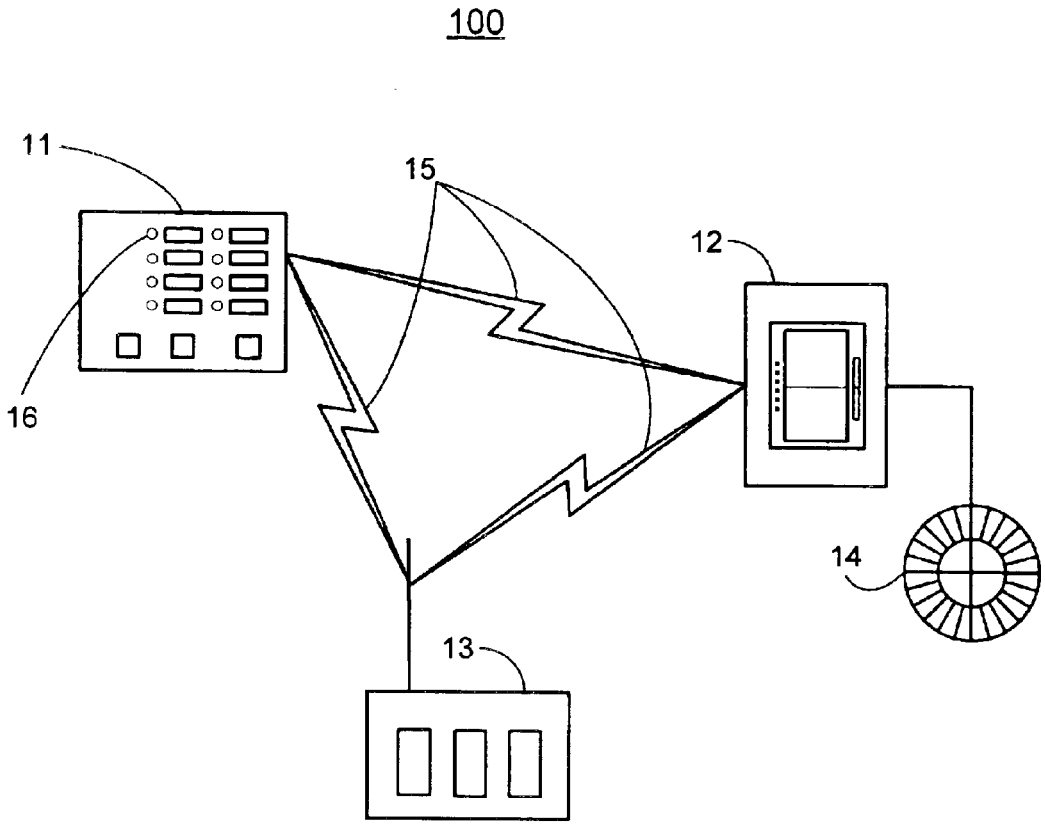
FIG. 1 is a block diagram illustrating an exemplary RF lighting control system.

Turning now to FIG. 1, a block diagram illustrating an exemplary RF lighting control system such as, for example, a RadioRA® system or the like is provided. The system 100 comprises a master control 11 for enabling a user to input commands to the system 100 and to view lighting status information that may be displayed on an indicator 16 which may comprise, for example, an LED, a LCD screen, or the like. Furthermore, system 100 comprises a lighting control device 12 such as, for example, a dimmer. Repeater 13, as the name implies, receives a signal from the master control 11 and/or the lighting control device 12 and retransmits such signal to provide increased range of RF transmissions. As may be appreciated, repeater 13 is optional, as in some applications master control 11 and lighting control device 12 are located such that both are able to communicate directly, without the need for repeater 13. Master control 11, lighting control device 12 and optional repeater 12 are operatively connected to each other by wireless communications links 15. As noted above, all devices of system 100 are operating at the same RF on each communications link 15.

A user chooses to enable a particular lighting scene by operating the master control 11 to initiate the scene. A signal is then communicated to the appropriate lighting control device 12 to perform a function required by the scene. It will be appreciated that the signal may be repeated by way of repeater 13 to ensure that the lighting control device 12 receives the signal. It will also be appreciated that the signal may contain various segments of information. For example, in addition to a command to perform a particular function, the signal may contain an identifier corresponding to the master control 11 and/or the lighting control device 12 or the like. Additional formatting information may be provided such as, for example, a house address for uniquely identifying the system 100. Any type of formatting or configuration of the signal is equally consistent with an embodiment of the present invention.

Once the signal has been received by the lighting control device 12, which then controls the light 14 if necessary, the lighting control device 12 sends a signal back to the master control 11. The master control 11 indicates a confirmation that the task was successfully completed by illuminating the indicator 16 or the like. The indicator 16 may represent any type of information such as, for example, intensity level of light 14, an on/off status and/or the like.

As may be appreciated, a user may operate a lighting control device 12 directly, if such user desires to affect only one light 14 by, for example, changing the lighting intensity of light 14. In such an embodiment, the lighting control device 12 may transmit a signal to the master control 11 to inform such master control 11 of the changed intensity. In such an embodiment, the changed status would be updated by indicator 16. Alternatively, the lighting control device 12 may wait until a signal is sent by the master control 11, so as to only update the status of the lighting control device 12 when polled by the master control 11. As may be appreciated, the RF lighting control system of FIG. 1 is merely exemplary, as any number or configuration of devices is consistent with an embodiment of the present invention.

It will be appreciated that in the system of FIG. 1 a "subnet" comprises at least one master control 11 and at least one lighting control device 12. As noted above, a repeater 13 need only be present when necessary to ensure that signals between master control 11 and lighting control device 12 are successfully sent and received. In contrast, in an embodiment of the present invention, and as will be discussed below in connection with FIG. 3–7, a subnet that is linked by a bridge need only comprise a single device. As will be seen below, a bridge according to an embodiment of the present invention contains the functionality of a master control 11. Therefore, a subnet in one embodiment need only comprise a single master control 11 or a single lighting control device 12, although greater numbers of devices are equally consistent with an embodiment of the present invention.

Bridging Method

Figure 2A:
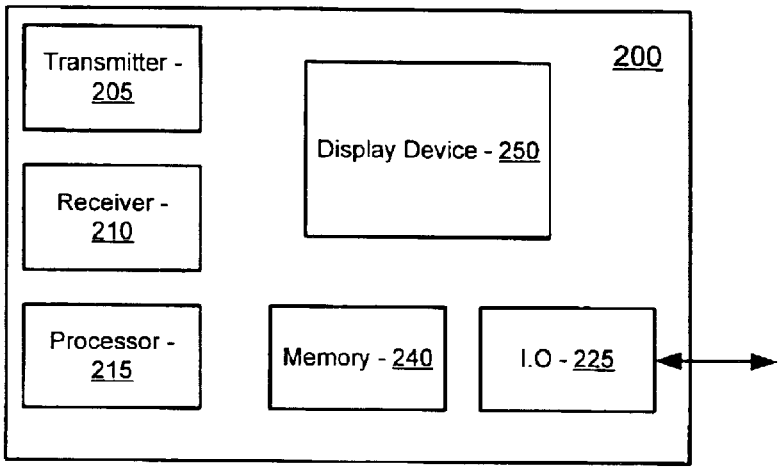
FIG. 2A is a block diagram of an exemplary bridging device in accordance with one embodiment of the present invention.

As noted above, in applications having more than one functionally related subnet in close proximity, the chances of encountering interference by having more than one device such as, for example, master control 11, transmitting at the same time increases. Therefore, in an embodiment of the present invention, a bridging device is provided. Turning now to FIG. 2A, a block diagram of an exemplary bridging device in accordance with one embodiment of the present invention is illustrated. Bridge 200 comprises a transmitter 205 and receiver 210 adapted to operate at the RF used by each subnet (not shown in FIG. 2A for clarity). Operatively connected to transmitter 205 and receiver 210 is processor 215, which may be a general purpose or specialized computing device adapted to control the functions of the bridge 200. As may be appreciated, processor 215 may comprise a single processor, or it may comprise a plurality of processors operating in parallel. For example, in one embodiment of the present invention, processor 215 comprises a first processor for controlling RF transmitting and receiving, as well as some Input/Output (I/O), and a second processor for controlling I/O, display and memory.

Operatively connected to processor 215 is memory 240, I/O 225 and a display 250. Memory 240 may be any type of data storage device such as, for example, RAM, flash memory, ROM and the like. I/O 225 may be any combination of devices for inputting data or instructions to bridge 200, or to display status information, instructions or the like. In addition, I/O 225 may comprise data connections such as a RS-232 connection or the like for connecting to external data sources. For example, in one embodiment, the bridge 200 receives timing information from an external device by way of I/O 225. Memory 240 may contain information that may be used in connection with such timing information. For example, memory 240 may contain sunrise and sunset information for one or more geographic locations that, then processed in the context of the received timing information by processor 215, enables the bridge 200 to take a predetermined action at sunrise or sunset. In another embodiment, such timing information may be generated internal to the bridge 200.

It will be appreciated that a user may interact with the bridge 200 by way of I/O 225 and the display 250. In one embodiment, the display 250 is an LCD screen displaying menu-driven prompts to a user who can interact with such menus by way of I/O 225. It will be appreciated that any type of display may be used while remaining consistent with an embodiment of the present invention. In addition, I/O 225 may comprise, for example, a rocker switch, a keyboard port, one or more buttons and the like that a user may manipulate to enter information and make selections in response to prompts displayed on display 250. It will also be appreciated that bridge 200 will have a housing (not shown in FIG. 2A for clarity) that may be formed so as to enable bridge 200 to be placed in a variety of locations. For example, bridge 200 may be placed in an out-of-sight area such as a closet, or may be cosmetically enhanced so as to be placed in a visible area of a house or building.

Figure 2B:
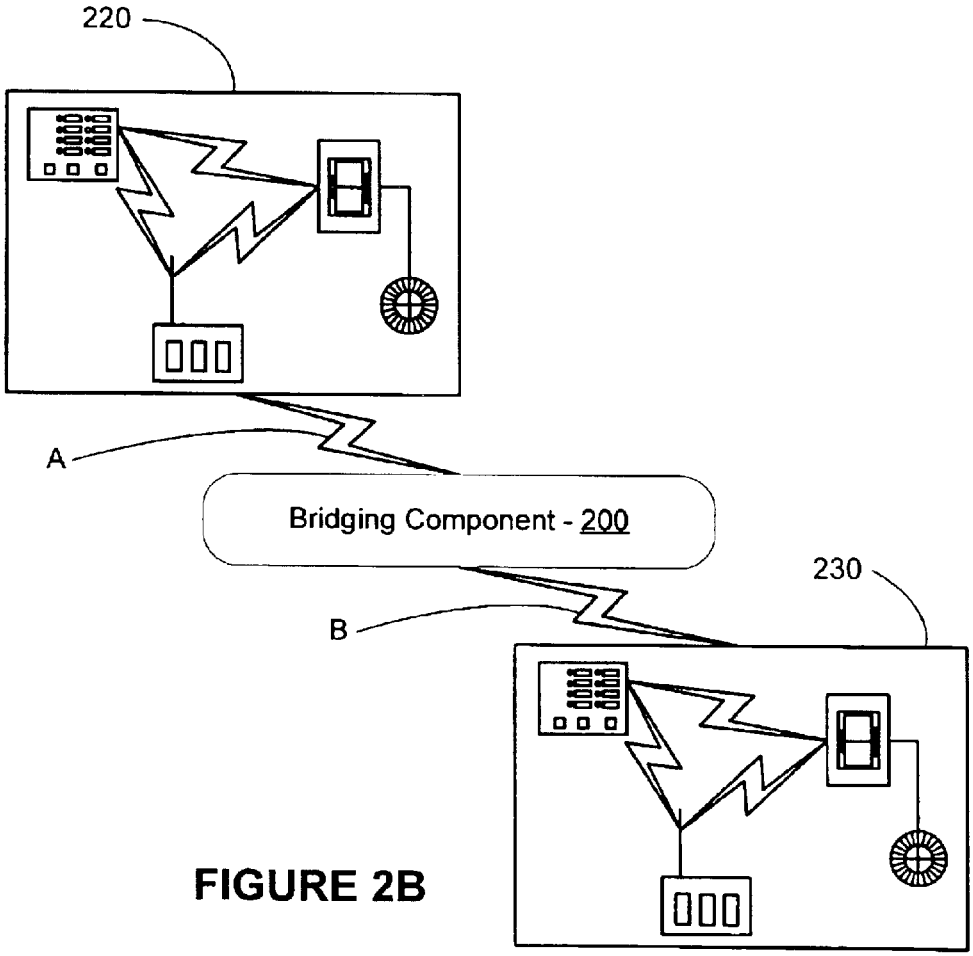
FIG. 2B is a block diagram of two exemplary RF lighting control systems operatively interconnected by way of a bridging device in accordance with one embodiment of the present invention.

The bridge 200 of one embodiment links multiple independent RF networks, or subnets, that are operating on the same frequency as illustrated in FIG. 2B. For example, FIG. 2B is a block diagram of two exemplary RF lighting control subnets 220 and 230 that are operatively interconnected by way of bridge 200 in accordance with one embodiment of the present invention. While subnets 220 and 230 are illustrated as having a master control 11, lighting control device 12, repeater 13 and lighting device 14, it will be appreciated that, as discussed above, a subnet 220 or 230 in accordance with an embodiment of the present invention need only comprise a single device.

As can be seen in FIG. 2B, subnet 220 is operatively connected by way of wireless connections A and B to subnet 230 by way of the bridge 200. As will be discussed below in connection with FIGS. 3–7, the use of such a bridge 200 provides subnets 220 and 230 with the ability to function in close proximity without creating message collisions on the shared RF when the bridge 200 is transmitting. In other words, when the bridge 200 transmits, it eliminates RF collisions between the subnets 220 and 230 by keeping the non-communicating subnet 220 or 230 silent during communications with the other subnet 220 or 230. In addition, bridge 200 also provides a means for subnets 220 and 230 to communicate with each other without one subnet interrupting the communication of another subnet. The bridge 200 still allows for subnets 220 and 230 to operate as independently functioning systems, while also providing an avenue for global operations between the independent subnets 220 and 230.

In one embodiment, lighting scenes that involve functionally related subnets 220 and 230 are implemented by way of "phantom" buttons of bridge 220. A phantom button is a virtual button that is programmed to have a specific function. Such a phantom button may be programmed by way of, for example, I/O 225 or the like. A particular phantom button may be programmed to create a customized lighting scheme that involves lighting devices, such as light 14 as discussed above in connection with FIG. 1, in a single or multiple subnets 220 and 230. In one such embodiment, the global operations include the operations of ALL ON (all lighting devices on), ALL OFF (all lighting devices off) and other programmable settings that may involve any number of lighting devices from any number of subnets. In one embodiment using the RadioRA® system described above, 15 programmable settings in addition to ALL ON and ALL OFF are provided. While some embodiments, such as an embodiment described below in connection with FIGS. 4–7, use two subnets, it may be appreciated that the use of any number of subnets is equally consistent with an embodiment of the present invention. The phantom buttons of bridge 200 therefore affect devices in both systems and can be used for controlling both subnets 220 and 230 from a master control 11 or by way of another device such as an RS-232 device.

In a single RadioRA® subnet, a user activates a lighting scene by, for example, pressing a button representing the lighting scene on a master control 11. In response, the master control 11 transmits RF signals to one or more lighting control devices 12 in accordance with predetermined settings for the lighting scene. In contrast, in one embodiment of the present invention, the master control 11 transmits an identifier representative of the selected lighting scene. The bridge 200 compares the received signal to a phantom button that corresponds to a lighting scene stored in, for example, memory 240. The bridge 200 then transmits the appropriate RF signals to one or more lighting control devices 12 in one or more subnets 220 and/or 230. Thus, a master control 11 in one subnet is able to control lighting control devices 12 in all subnets 220 and 230.

In another embodiment, a bridge 200 may be used with a master control 11 that is operating in a manner consistent with an existing, single subnet, RadioRA® system. For example, in some embodiments a bridge 200 may be added to a pre-existing subnet 220 and/or 230 in connection with one or more devices comprising an additional subnet. It will be appreciated that such a situation may arise when, for example, an existing subnet has reached its capacity, and one or more additional subnets are required. As a result, one or more master controls 11 may not be configured to only transmit a scene identifier in response to a button press. In such an embodiment, and as will be discussed below in connection with FIGS. 3–8, the bridge 200 waits for the transmitting master control 11 to finish transmitting, identifies the corresponding phantom button, and then transmits the appropriate RF signals to the appropriate lighting control devices 12. While, in such an embodiment, commands may be sent to some lighting control devices 12 twice—once by the master control 11 and once by the bridge 200—it will be appreciated that the bridge 200 is equally compatible with either type of master control 11 RF transmission protocol.

In an embodiment of the present invention, a RadioRA® RF transmission protocol is used. In such a protocol, devices attempt to avoid RF collisions by way of wait times and backoffs. A wait time is an amount of time a device receiving a RF signal should wait after the signal ends before transmitting a signal. Wait times are assigned by a transmitting device to a receiving device. A backoff time is also an amount of time a device receiving a RF signal should wait after the signal ends before transmitting a signal. However, a backoff time differs from a wait time in that a backoff time is assumed by a receiving device, rather than being assigned to a receiving device. A device receiving an RF signal, upon detecting the signal, assigns itself a backoff time to wait after the signal ends to avoid interfering with any additional RF signals. Once the backoff time has expired, and if no further RF signals are received, the device is free to transmit if necessary. In one embodiment, the length of backoffs are determined randomly, so that devices waiting to transmit are less likely to transmit a RF signal at the same time once the backoffs have expired.

Figure 3:
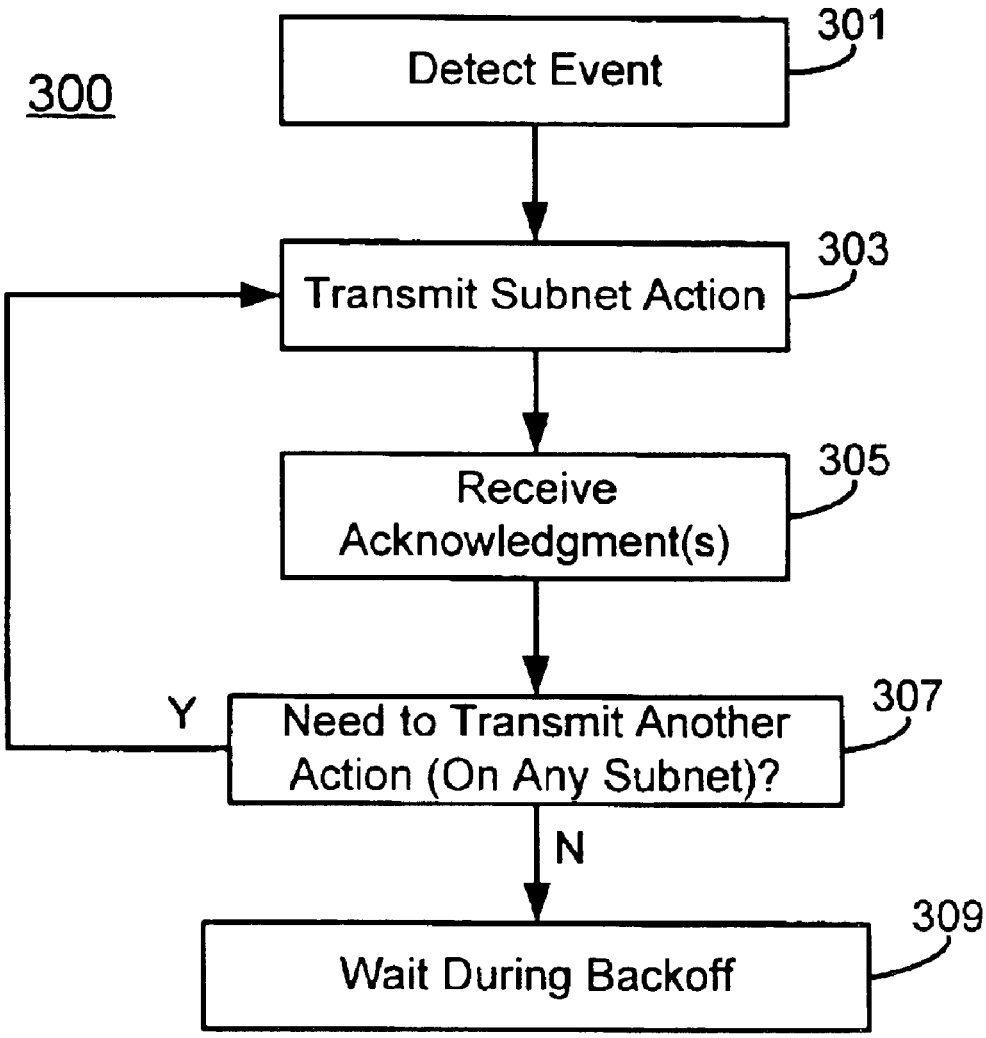
FIG. 3 is a flowchart illustrating a method of bridging two RF lighting control systems in accordance with an embodiment of the present invention.

Turning now to FIG. 3, a flowchart illustrating an exemplary method of bridging two RF lighting control subnets 220 and 230 in accordance with an embodiment of the present invention is provided. At step 301, an event is detected by bridge 200. Such an event may be an RF transmission from a master control 11, or a lighting control device 12 in a subnet such as, for example, subnet 220 of FIG. 2 as discussed above. In addition, an event may be a button press or the like on bridge 200 itself by way of I/O 225. As may be appreciated, if such event is an RF transmission, such transmission may comprise a lighting scene identifier, commands to lighting control devices, and/or the like. In an embodiment, bridge 200 also assumes a random backoff so as to avoid interfering with the RF transmission before proceeding to steps 303–309.

At step 303, the bridge 200 transmits a subnet action to both subnet 220 and 230 to "reserve" the operating RF. As will be discussed below in connection with FIGS. 4–8, a subnet action is typically initiated with a link claim. The link claim announces to the subnets 220 and 230 that a command is about to be sent, and once each subnet 220 and 230 receives the link claim, every device in each subnet 220 and 230 stops transmitting and waits for a transmission from the bridge 200. As discussed above, each device, upon receiving the RF signal comprising the link claim, assumes a backoff. In one embodiment, the backoff is a random value that is within a predetermined range. In addition to a link claim, the subnet action may comprise one or more commands to one or more devices. Thus, the subnet action is able to effectuate all or part of a lighting scene. As may be appreciated, the subnet action may also comprise a household identifier, device identifier, and the like. It will also be appreciated that, in some embodiments, the subnet action repeats the subnet action one or more times to ensure safe reception of commands. As was also discussed above, in one embodiment the bridge 200 transmits random wait times to devices in the target subnet 220 and 230.

At step 305 acknowledgements from devices such as master control 11 and/or lighting control devices 12 are received. As may be appreciated, in some embodiments block 305 may be optional if such acknowledgments are not transmitted as part of the embodiments' communications scheme. At step 307, a determination is made as to whether the bridge 200 will execute another subnet action on any subnet 220, 230. If so, the method returns to step 303 to transmit another subnet action. Upon completing all necessary subnet actions, bridge 200, at step 309, waits during device backoffs. After such time, other devices are free to transmit an RF signal as needed.

Figure 4:
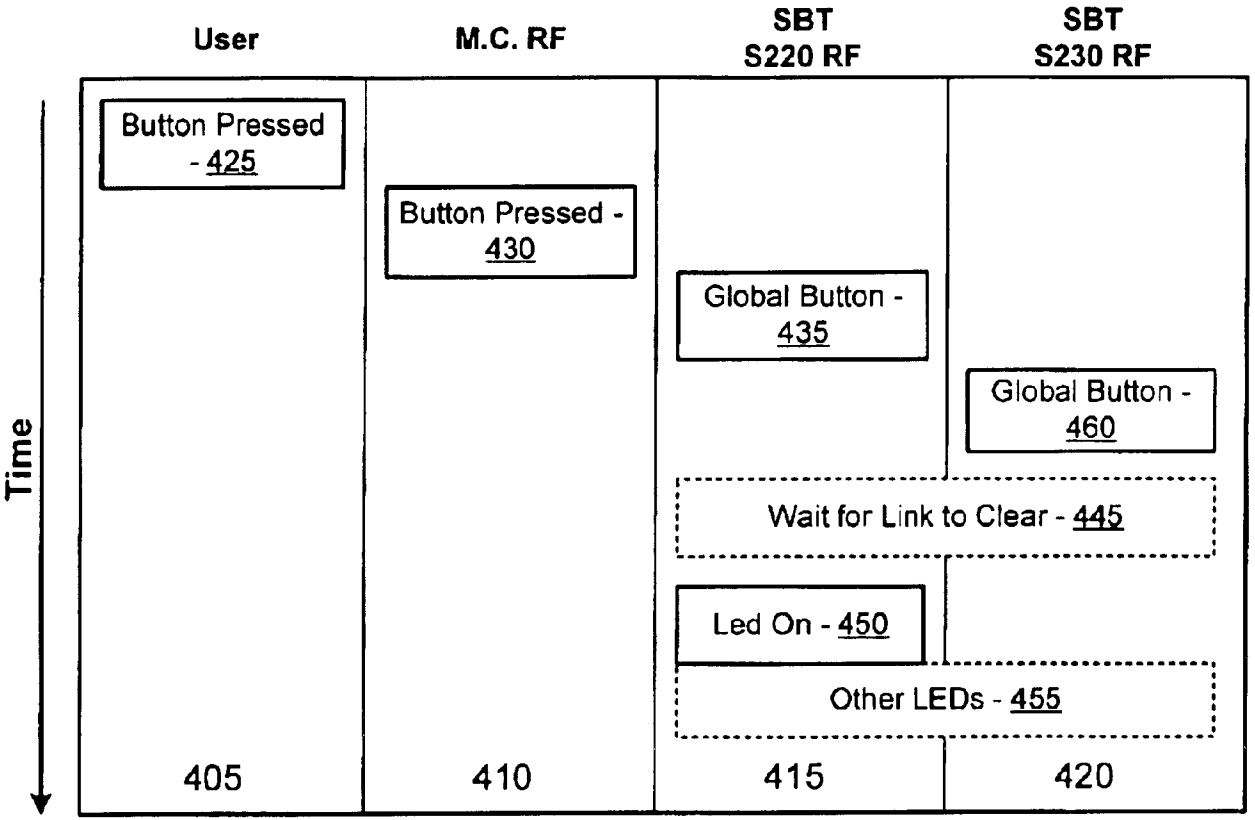
FIG. 4 is an exemplary timing diagram of a bridging system in accordance with one embodiment of the present invention.

Turning now to FIG. 4, an exemplary timing diagram of a bridging system in accordance with one embodiment of the present invention is provided. In the system 400, block 405 represents user actions, block 410 represents master control 12 actions within subnet 220, and blocks 415 and 420 represent actions of the bridge 200 in subnet 220 and 230, respectively. Blocks 425–460 illustrate an exemplary series of actions in accordance with one embodiment of the present invention. As will be appreciated, the embodiment of FIG. 4 provides an example of a global button, where one or more devices, such as lighting control devices 12, lights 14 and the like are affected in two or more subnets 220 and 230. An example of such a global button is, for example, the ALL ON and ALL OFF buttons discussed above in connection with FIGS. 2A–B.

Figure 6A:
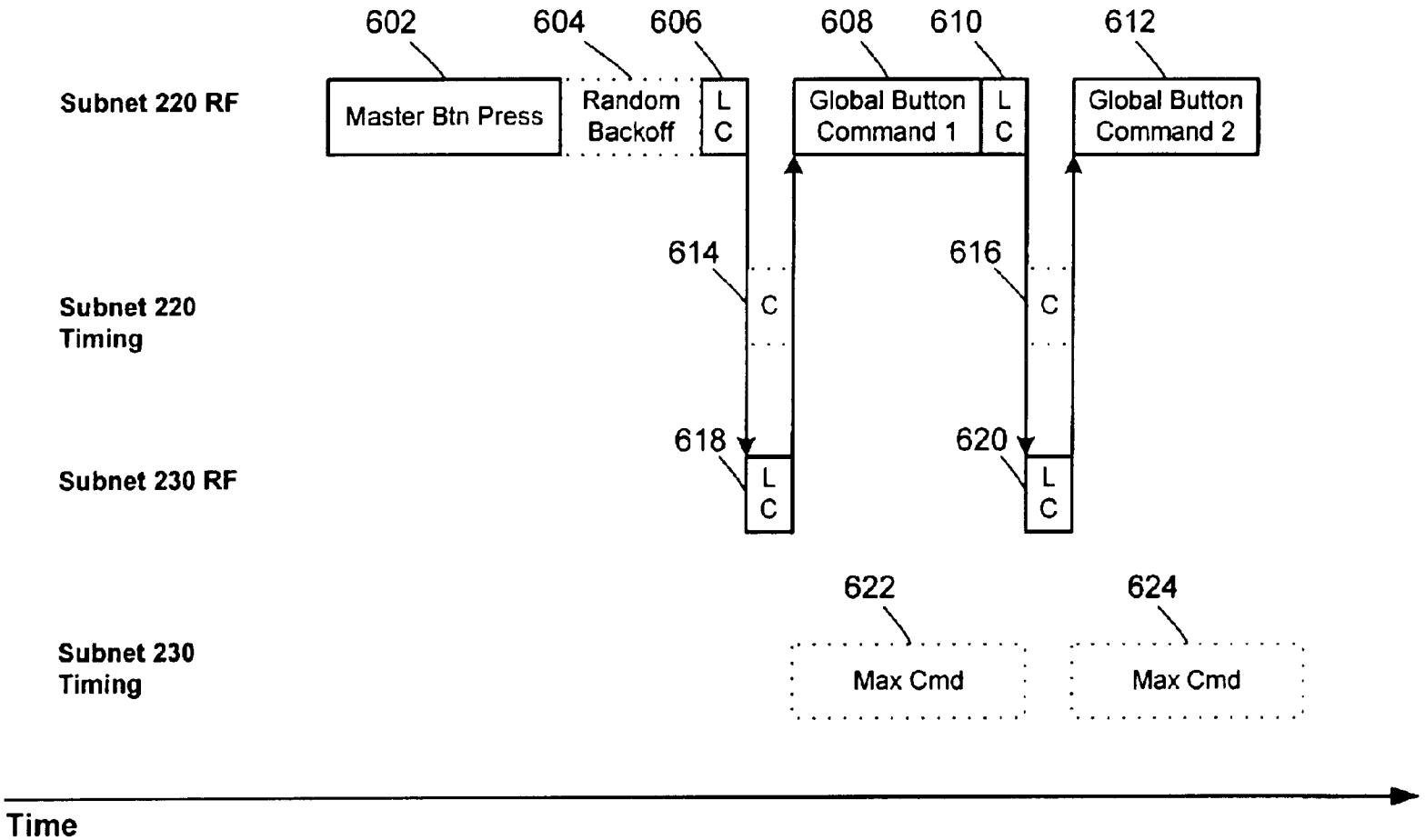
FIGS. 6A–C are exemplary timing diagrams of a communications protocol to implement successive commands in a single subnet in accordance with one embodiment of the present invention.
Figure 6B:
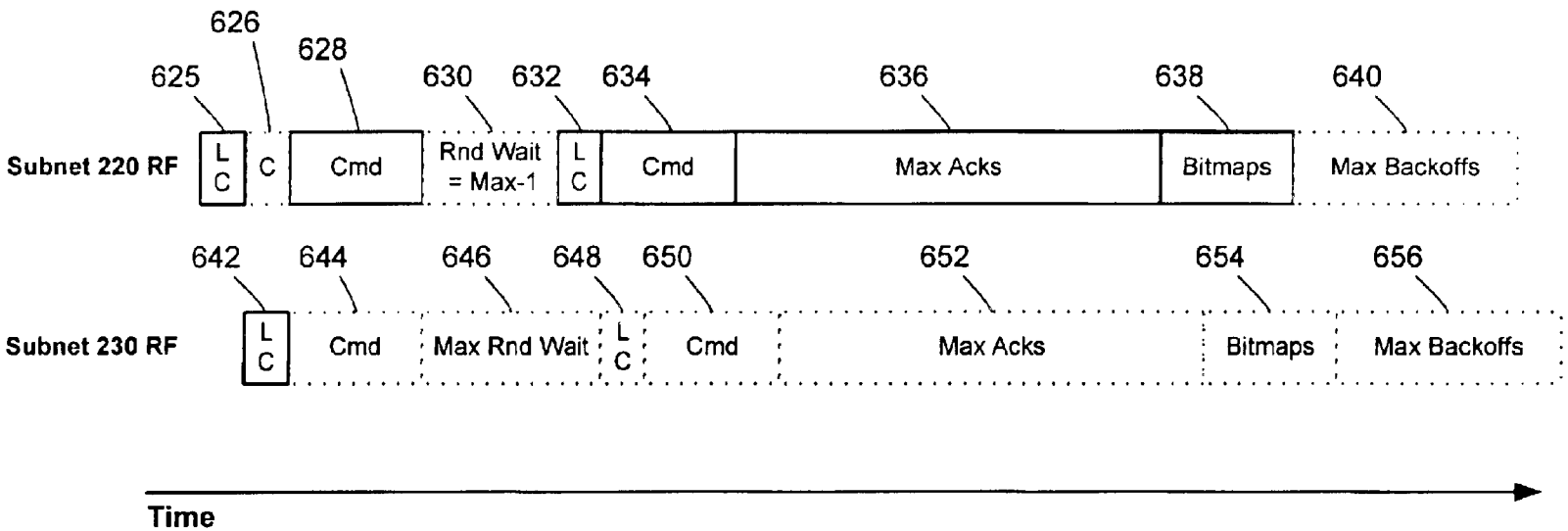
Figure 6C:
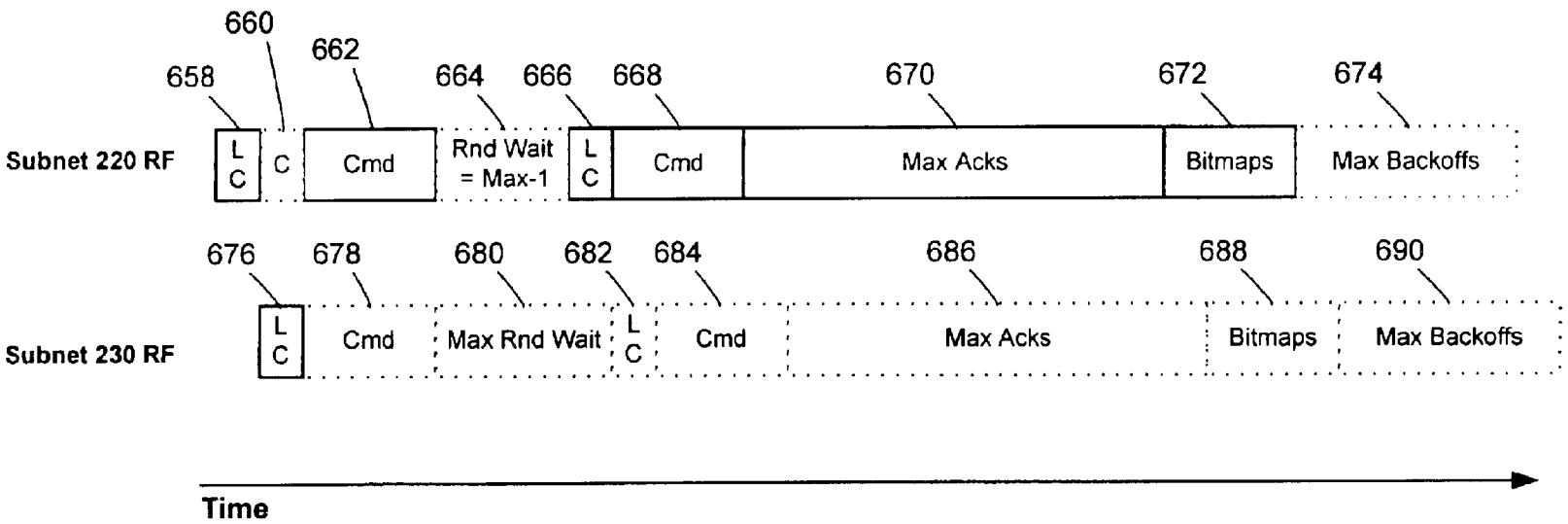
Figure 7A:
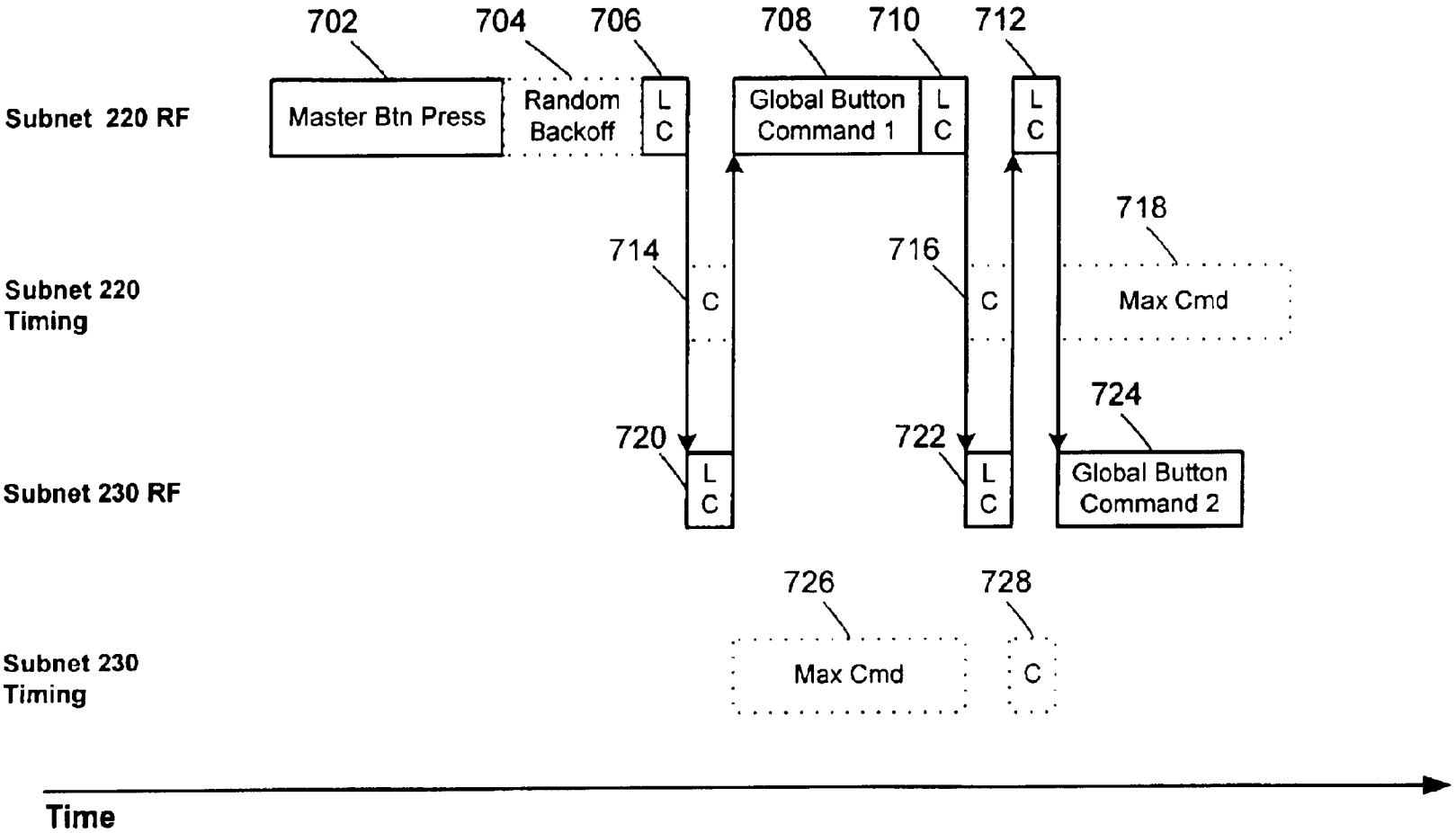
FIGS. 7A–C are exemplary timing diagrams of a communications protocol to implement successive commands across two subnets in accordance with one embodiment of the present invention.
Figure 7B:
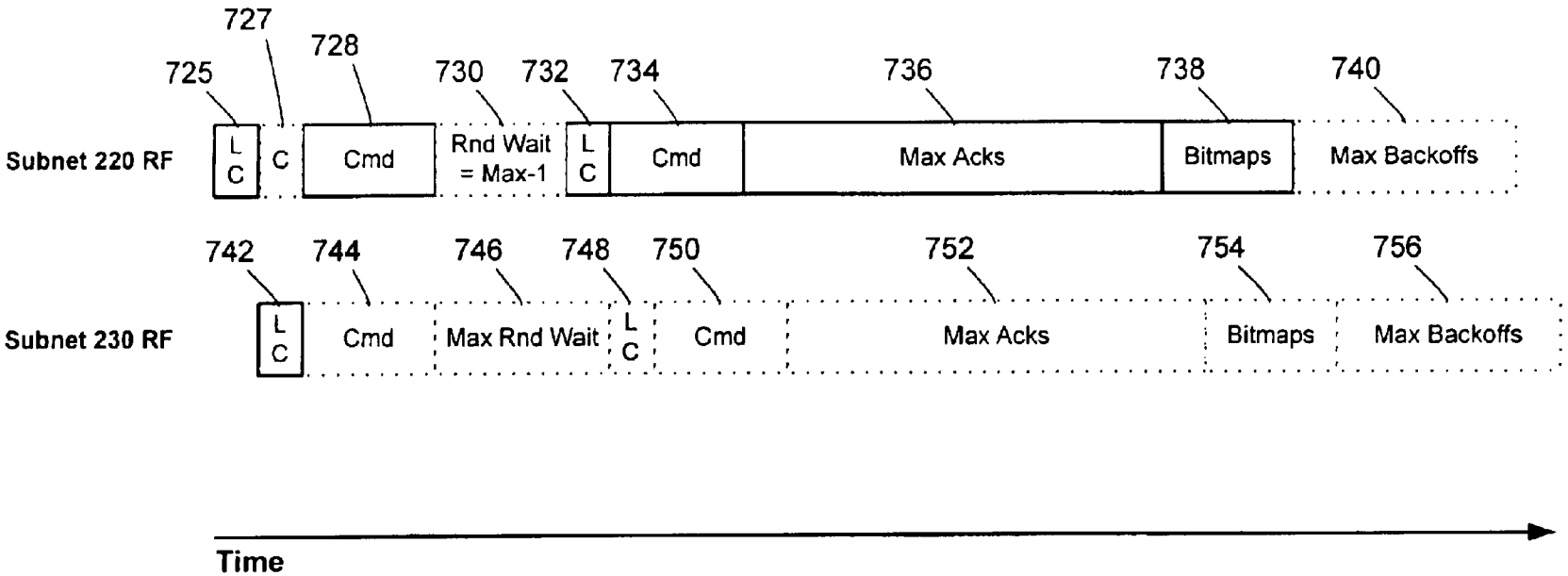
Figure 7C:
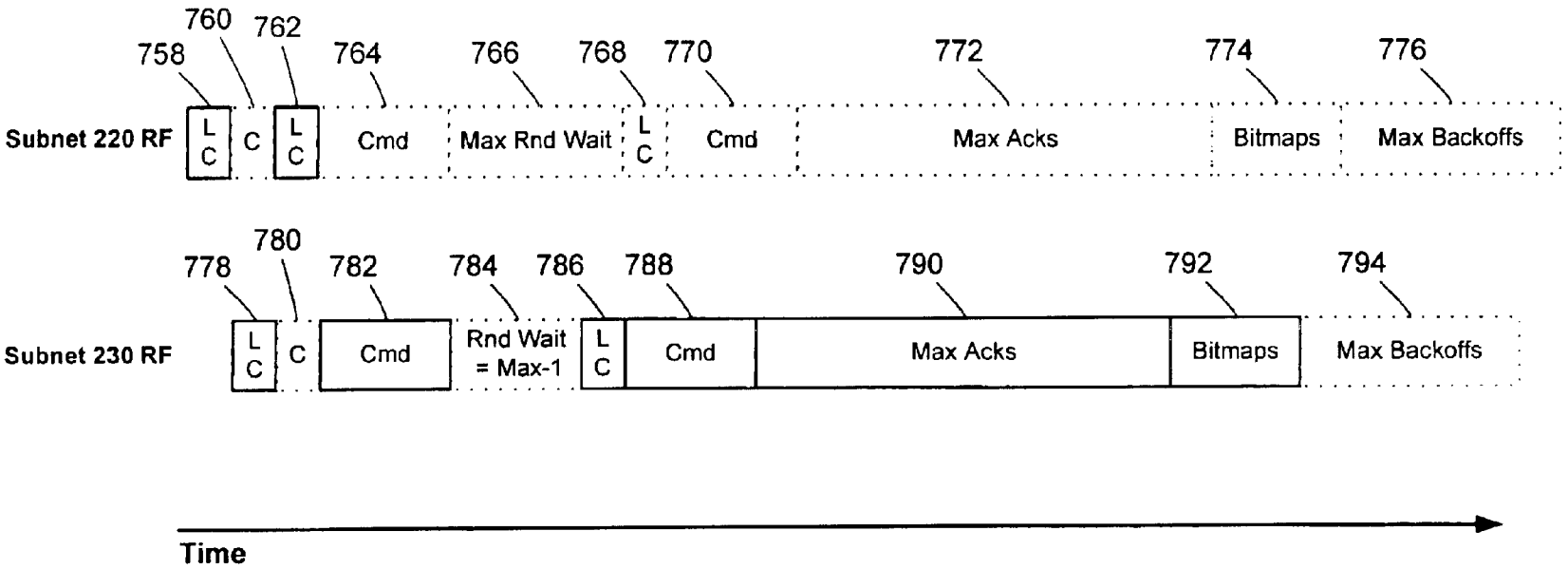

At block 425, a button is pressed by a user, and in response master control 12 sends a signal at block 430 to indicate that such button was pressed. At block 435, bridge 200 transmits a global button signal in subnet 220. As will become apparent, block 435 is equivalent to blocks 706–708, 714, 720 and 726 of FIG. 7A, as well as to blocks 725–756 of FIG. 7B, all of which will be discussed below. As may be appreciated, processor 215 or the like of bridge 200, upon receiving the signal of block 430, may look up in memory 240 or the like a phantom button corresponding to a lighting scene. In other words, a global button on master control 12 of subnet 220 may correspond to any preprogrammed scene of a phantom button in the bridge 200. Bridge 200 determines whether the button depressed by the user is local to subnet 220, in which case a process such as that discussed below in connection with FIGS. 6A–C is followed, or is a button that affects both subnets 220 and 230, in which case a process such as that discussed below in connection with FIGS. 7A–C is followed.

In the present embodiment of FIG. 4, and as noted above, a global button is transmitted at block 435 in subnet 220 by bridge 200. As will be discussed below, in one embodiment block 435, as well as block 460, comprises a link claim, command, and a period of time in which to receive acknowledgements. At block 460, the global button is transmitted in subnet 230 by bridge 200. In addition, it will be appreciated that block 460 is equivalent to blocks 710, 712, 716, 718, 722, 724 and 728 of FIG. 7A, as well as to blocks 758–794 of FIG. 7C, all of which will be discussed below. At block 445, both subnets 220 and 230 wait for the link to clear. Block 445 may comprise, for example, waiting during backoffs as discussed above in connection with step 309 of FIG. 3. At block 450, the display 250 of bridge 200, an indicator 16 of master control 12 or the like is illuminated by way of, for example, a LED. As may be appreciated, the process of illuminating LEDs and the like, as represented by block 450, may also involve the transmission of signals in accordance with the method of FIG. 3.

At block 455, other LEDs or display devices such as display 250 and/or indicator 16 are activated. Hence, it will be appreciated that an embodiment of the present invention permits lighting control commands that are a part of global buttons and the like to execute first, while acknowledgement LEDs and the like are delayed until the end of such commands. In such a manner, the response time of lights 14 and the like, which is the most noticeable outcome to a user, is reduced at the expense of a slight delay in the updating of status indicators, which are not as noticeable to a user.

Crosstalk

The method of FIG. 3, above, may be better understood in the context of examples of such method's implementation. While FIGS. 5–7, below, illustrate only two subnets 220 and 230, it may be appreciated that any number of subnets 220–230 may be operatively interconnected by way of the bridge 200. While the time required to control numerous subnets may increase, the methods disclosed herein are equally applicable to any number of subnets. In addition, it will be appreciated that the timing diagrams are for illustrative purposes only, as actual timing diagrams may have more or fewer blocks and/or functions taking place to effectuate the desired commands. Thus, an embodiment of the present invention provides a communications framework upon which a lighting control system may be implemented.

Figure 5:
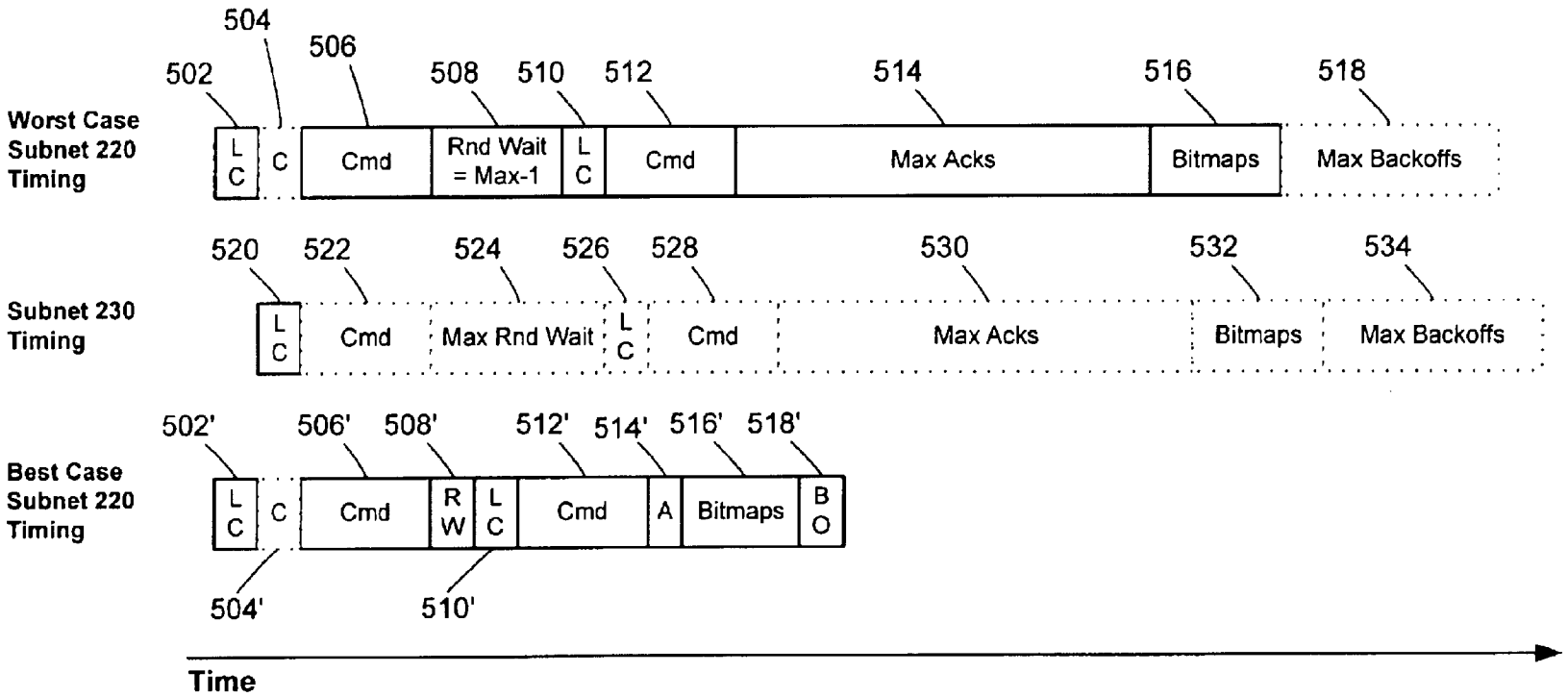
FIG. 5 is an exemplary timing diagram of a communications protocol to overcome a crosstalk situation in accordance with one embodiment of the present invention.

Turning now to FIG. 5, an exemplary timing diagram of a communications protocol to overcome a crosstalk situation in accordance with one embodiment of the present invention is illustrated. As can be seen in FIG. 5, in addition to FIGS. 6–7, below, time progresses in the direction of the time axis. As may be appreciated, none of FIGS. 5–7 are exactly to scale, as any time, communications protocol, or frequency may affect the exact spacing of the blocks.

A crosstalk situation exists where devices in one subnet are communicating to each other only, but the close proximity of another subnet operating on the same frequency causes interference, or "crosstalk." Thus, FIG. 5 illustrates describes a basic communication event initiated by subnet 220 to a device contained therein, while a second subnet 230 is present. The timing diagrams illustrate the communications that occur according to the bridge 200 so as to avoid crosstalk. Three bitstreams are illustrated FIG. 5, each of which indicates the timing of subnets 220 and 230 during such a communication event involving bridge 200.

In one embodiment of the present invention, the random wait times discussed above in connection with steps 307 and 313 are assigned by an initiating subnet 220. Thus, in the present crosstalk example of FIG. 5, subnet 220, including the devices contained therein, assigns itself a random wait time, while subnet 230 is assigned the maximum random wait time. Likewise, each device in each subnet 220 and 230 will assume a random backoff upon receiving a RF signal. Thus, the "worst case" of FIG. 5 assumes that the largest possible backoff is assumed, while the "best case" assumes that the smallest possible backoff is assumed. Therefore, and as may be appreciated, the "worst case" timing for subnet 220, as illustrated by blocks 502–518, occurs when the random wait times are the largest possible values. It will be appreciated that FIGS. 6B, 6C, 7B and 7C, to be discussed below, illustrate such a worst case timing.

In one embodiment of the present invention, there are four possible random wait and five backoff values that may be assigned or assumed, respectively. As may be appreciated, any number of wait time and/or backoff values is equally consistent with an embodiment of the present invention. In addition, values of wait times/backoffs are, in one embodiment, a multiple of the amount of time necessary for a link claim. A link claim may be any amount of time such as, for example, five or 14 half-cycles. As subnet 230 is assigned a maximum wait time according to one embodiment, only one timing diagram, as illustrated by blocks 520–534, is needed. As can be seen in FIG. 5, as well as in FIGS. 6–7 below, solid blocks represent actual RF transmissions and dotted blocks represent RF timing.

While the bridge 200 is transmitting, the bridge 200 assumes a backoff time of zero, so the bridge 200 is permitted to immediately transmit as soon as the command has completed. As may be appreciated, such a configuration enables the bridge 200 to maintain control of subnets 220 and 230 because the bridge 200 will always be able to transmit first after a command has executed. Once the backoff has expired, if a second command is to be executed, a second link claim may be re-sent to subnets 220 and 230 to ensure the RF remains free. The command is then re-sent to requesting subnet 220 and executed accordingly. Thus, although both subnets 220 and 230 have received the message that a command is coming, only the requesting subnet 220 actually receives and executes the command.

Accordingly, upon receiving a command from subnet 220, the bridge 200 sends a link claim to both subnet 220 and 230 in order to "reserve" the operating RF. As may be appreciated, and as discussed above, the command received from subnet 220 may comprise a scene identifier. Alternatively, such a command may comprise commands to devices within subnet 220, such as lighting control devices 12, so as to effectuate a desired lighting scene. The initial link claim to subnet 220 is represented by blocks 502 and 502', while the link claim to subnet 230 is represented by block 520. Blocks 504 and 504' represent subnet 220's status as waiting for a command, according to the link claim. By subnet 220 reserving the RF, subnet 230 temporarily halts its communication capability so the bridge 200 may communicate with subnet 220 without interference.

Blocks 506 and 506' represent the command sent by subnet 220, while subnet 230 continues to wait at block 522. Block 522, for example, represents subnet 230 as it waits for a command, according to having received a link claim at block 520, but as may be appreciated the command does not arrive. As a result, subnet 230 remains silent, which enables the bridge 200 and devices in subnet 220 to communicate without the threat of a message collision. At blocks 508 and 508', subnet 220 is assigned a worst-case and best-case random wait time, respectively, while subnet 230 is assigned a maximum wait time at block 524. As will be discussed below in connection with FIGS. 6 and 7, the worst-case random wait for subnet 220 in the present example is any amount of time less than the maximum possible random wait time.

In the present exemplary communication event of FIG. 5, the command is automatically resent to ensure it is properly received by all devices, so at blocks 510, 510' and 526, a second link claim is sent to subnets 220 and 230, respectively. At blocks 512 and 512', the command is resent to subnet 220 while subnet 230 waits for a command at block 528. The command is then acknowledged by all devices in subnet 220, as represented by blocks 514 and 514'. Any method of transmitting, receiving and collecting device acknowledgments is equally consistent with an embodiment of the present invention.

As may be appreciated, the worst-case acknowledgment of block 514 would correspond to, for example, a subnet having numerous devices. In the context of the RadioRA® system described above, longer acknowledgment times could result as the maximum number of 32 devices is approached. Meanwhile, subnet 230 continues to wait at block 530. At blocks 516 and 516', bitmaps are exchanged to ensure that, for example, display 16 of master control 11 of subnet 220 is updated. Subnet 230 continues to wait at block 532. At the completion of the command sequence, subnet 220 waits for the duration of its assumed backoff at block 518'—representing the minimum backoff—and at block 518—representing the maximum backoff. Likewise, subnet 230 waits for the duration of its backoff at block 534.

As may be appreciated, and as noted above, it is a function of one embodiment of the present invention that during the time that subnet 220 receives and executes its commands, subnet 230 is prohibited from communicating over the RF. According to this embodiment, subnet 230 must wait until its backoff has expired, and the RF is open and available before it can attempt communications.

Successive Commands to the Same Subnet

In some embodiments, and as noted above, the bridge 200 is further enabled to maintain control of the RF in multiple subnets by assuming a backoff of zero time duration. This allows the bridge 200 to send successive commands to either the same subnet or a different subnet. When two global buttons are pressed, for example, the process for sending one command is repeated for the transmission of a second command. As was the case with FIG. 5, the bridge 200 keeps the non-requesting subnet, for example subnet 230, from transmitting while successively sending both commands to the requesting subnet 220.

Turning now to FIG. 6A, an exemplary timing diagram of a communications protocol to implement successive commands in a single subnet in accordance with one embodiment of the present invention is illustrated. FIG. 6A shows the process of sending successive commands into the same subnet, which for illustrative purposes is subnet 220. Blocks 602–612 represent subnet 220's RF transmissions, blocks 614 and 616 represent subnet 220's RF timing, blocks 618 and 620 represent subnet 230's RF transmissions and blocks 622 and 624 represent subnet 230's RF timing.

At block 602 a master button is pressed on, for example, master control 11 or bridge 200. At block 604, a random backoff occurs until a link claim is transmitted to subnet 220 at block 606, and to subnet 230 at block 618 while subnet 220 waits for a command at block 614. At block 608, a first command to effectuate an exemplary global button is transmitted, while limiting the maximum wait time to less than an exemplary 4 units, as will be discussed in greater detail below in connection with FIG. 6B. As may be appreciated, block 608 is functionally equivalent to blocks 506–516 as discussed above in connection with FIG. 5. Meanwhile, subnet 230 waits at block 622. Because a second command will be issued, a link claim is transmitted at blocks 610 and 620, wherein block 620 occurs while subnet 220 waits for a command at block 616. At block 612, a second command to effectuate exemplary global button 2 is transmitted, as will be discussed in greater detail in connection with FIG. 6C. Meanwhile, subnet 230 waits at block 624.

In a similar fashion to the single command process discussed above in connection with FIG. 5, after receiving the signal from subnet 220, a link claims is sent to both subnets 220 and 230 by bridge 200 to reserve the RF for the requesting subnet 220. Upon completion of the first command, non-requesting subnet 230 is assigned the maximum random wait time while requesting subnet 220 is assigned a random wait time. Because the requesting subnet, subnet 220, will have the smaller wait time, another link claim can be sent to subnet 230 to enable processing any queued button presses. This assignment of a maximum random wait time to subnet 230 is a means for providing bridge 200 with the ability to maintain control of the RF and to continue communicating with subnet 220. The execution of the commands are then completed accordingly. Once the final command is executed and completed by bridge 200, random backoffs are assumed by devices in both subnets 220 and 230.

Therefore, and turning to FIG. 6B, a detail of global button 1, blocks 606, 608, 614, 618 and 622 of FIG. 6A, is illustrated. As can be seen in FIG. 6B, subnet 220's RF transmissions are illustrated by blocks 625–640, and subnet 230's RF transmissions are illustrated by blocks 642–656. A first and second link claim, including a time where the subnet 220 is waiting for a command while the second link claim is issued in subnet 230, occurs at blocks 625, 626 and 642. The command is issued to subnet 220 at block 628 while subnet 230 waits for a command at block 644. Then, a random wait time is assigned to subnet 220 at block 630 which, in the exemplary embodiment of FIG. 6B, is some amount of time less than the maximum random wait time, as indicated in FIG. 6B as "max-1" to indicate one wait time value less than the maximum. It will be appreciated that any amount of time less than the maximum wait time is equally consistent with an embodiment of the present invention.

Subnet 230 is assigned a maximum wait time at block 646. Then, and as was discussed above in connection with FIG. 4 above, another link claim is issued, the command repeated and acknowledgements collected from subnet 220 at blocks 632–636, while subnet 230 waits at blocks 648–652. Bitmaps are collected at block 638 while subnet 230 waits at block 654. Finally, subnets 220 and 230 wait for the duration of their assumed backoffs at blocks 640 and 656, respectively.

As may be appreciated, and turning now to FIG. 6C, a detail of global button 2, corresponding to blocks 610, 612, 616, 620 and 624 of FIG. 6A, occurs in the same manner as described above in connection with FIG. 6B. As can be seen in FIG. 6C, subnet 220's RF transmissions are illustrated by blocks 658–674, and subnet 230's RF transmissions are illustrated by blocks 676–690. A first and second link claim, including a time where the subnet 220 is waiting for a command while the second link claim is issued in subnet 230, occurs at blocks 658, 660 and 676. The command is issued to subnet 220 at block 662 while subnet 230 waits for a command at block 678. Then, a random wait time is assigned to subnet 220 at block 664 which, in FIG. 6B, is an amount of time less than the maximum random wait time, while subnet 230 is assigned a maximum wait time at block 680. Then, and as was discussed above in connection with FIG. 4 above, another link claim is issued, the command repeated and acknowledgements collected from subnet 220 at blocks 666–670, while subnet 230 waits at blocks 682–686. As was the case with FIG. 6B above, bitmaps are collected at block 672 while subnet 230 waits at block 688. Finally, subnets 220 and 230 wait for the duration of their assumed backoffs at blocks 674 and 690, respectively.

Successive Commands in Different Subnets

As was the case with implementing successive commands in the same subnet as discussed above in connection with FIGS. 6A–C, above, in an embodiment of a two subnet system, the bridge 200 will respond to a button press from a master control 11 by sending link claims to both subnets 220 and 230 to reserve the RF for communication. A difference between switching subnets 220 and 230 as opposed to the method illustrated above in connection with FIGS. 7A–C is the location of the execution of the second command and the additional link claim added before the second command is sent. As will be discussed below in connection with FIGS. 7A–C, the additional link claim is to ensure the RF is clear before the next command is sent. The open RF allows the bridge 200 the flexibility of sending another command to subnet 220 or to subnet 230.

Turning now to FIG. 7A, an exemplary timing diagram of a communications protocol to implement successive commands across two subnets 220 and 230 in accordance with one embodiment of the present invention is shown. FIG. 7A shows the process of sending successive commands into two different subnets, which for illustrative purposes are subnets 220 and 230. Blocks 702–712 represent subnet 220's RF transmissions, blocks 714–718 represent subnet 220's RF timing, blocks 720–724 represent subnet 230's RF transmissions and blocks 726–728 represent subnet 230's RF timing. As was the case at block 602 of FIG. 6A, discussed above, at block 702 a master button is pressed on, for example, master control 11 or bridge 200. At block 704, a random backoff occurs until a link claim is transmitted to subnet 220 at block 706, and to subnet 230 at block 720 while subnet 220 waits for a command at block 714.

At block 708, a first command to effectuate exemplary global button 1 is transmitted, while limiting a random wait time to less than a maximum random wait time. Meanwhile, subnet 230 waits at block 726. Because a second command will be issued, this time into subnet 230, a link claim is transmitted for both subnets 220 and 230 at blocks 710 and 722, wherein block 722 takes place while subnet 220 waits for a command at block 716. At block 712, and unlike the example of FIG. 6A, a second link claim is issued to subnet 220 to prevent the maximum wait period from expiring prior to the bridge 200's completion of all commands into subnet 230 at block 724. Thus, subnet 230 waits for a command at block 728. In addition, the second link claim ensures that any pending RF traffic from either subnet 220 or 230 will be queued at such subnet so as to avoid message collisions. Thus, the bridge 200 ensures that it will maintain control of each subnet 220 and 230 while either transmitting new commands and/or switching between subnets 220 and 230.

It will be appreciated that the necessity for transmitting a second link claim into subnet 220 is a result of creating the smallest possible wait time after a link claim. When the bridge 200 is only communicating with one subnet, such as for example subnet 220, as is the case with FIGS. 6B–C, above, and FIG. 7B, below, the wait period for subnet 230 will not permit it to begin transmitting on a RF link while subnet 220 is active. However, and as is the case with FIG. 7C, below, when subnet 220 receives a link claim, and then waits for subnet 230 to receive a link claim and a command, and then waits for the maximum random wait, it is possible that, if subnet 230 is assigned a long random wait approaching the maximum random wait, subnet 220 may begin to transmit RF signals before subnet 230 has completed. Thus, the second link claim to subnet 220 ensures that the RF link remains clear. Referring again to FIG. 7A, at block 724, a second command to effectuate an exemplary global button is transmitted, as will be discussed in greater detail in connection with FIG. 7C. Meanwhile, subnet 220 waits at block 718.

Turning now to FIG. 7B, a detail of such global button, corresponding to blocks 706, 708, 714 and 720 of FIG. 7A, is illustrated. As can be seen in FIG. 7B, subnet 220's RF transmissions are illustrated by blocks 725–740, and subnet 230's RF transmissions are illustrated by blocks 742–756. A first and second link claim, including a time where the subnet 220 is waiting for a command while the second link claim is issued in subnet 230, occurs at blocks 725, 727 and 742. The command is issued to subnet 220 at block 728 while subnet 230 waits for a command at block 744. Then, a random wait time is assigned to subnet 220 at block 730 which, in the exemplary embodiment of FIG. 7B, is one time unit smaller than a maximum random wait time, while subnet 230 is assigned a maximum random wait time at block 746. Then, and as was discussed above in connection with FIGS. 5 and 6B above, another link claim is issued, the command repeated and acknowledgements collected from subnet 220 at blocks 732–736, while subnet 230 waits at blocks 748–752. Bitmaps are collected at block 738 while subnet 230 waits at block 754. Finally, subnets 220 and 230 wait for the duration of their assumed backoffs at blocks 740 and 756, respectively.

As may be appreciated, and turning now to FIG. 7C, a detail of global button 2, corresponding to blocks 710, 712, 716, 718, 722, 724 and 728 of FIG. 7A, occurs in a similar manner as described above in connection with FIGS. 7A–B. As can be seen in FIG. 7C, subnet 220's RF transmissions are illustrated by blocks 758–776, and subnet 230's RF transmissions are illustrated by blocks 778–794. A first and second link claim, including a time where the subnet 220 is waiting for a command while the second link claim is issued in subnet 230, occurs at blocks 758, 760 and 778. As noted above in connection with FIG. 7A, a third link claim—the second in subnet 220—is transmitted at block 762 while subnet 230 waits for a command at block 780. A command is issued to subnet 230 at block 782 while subnet 220 waits for a command at block 764. Then, a random wait time is assigned to subnet 230 at block 784 which, in FIG. 7B, is one time unit smaller than a maximum random wait time according to, while subnet 220 is assigned a maximum random wait time at block 766. Then, and as was discussed above in connection with FIG. 5, another link claim is issued, the command repeated and acknowledgements collected from subnet 230 at blocks 786–790, while subnet 220 waits at blocks 768–772. Bitmaps are collected at block 792 while subnet 220 waits at block 774. Finally, subnets 220 and 230 wait for the duration of their assumed backoffs at blocks 776 and 794, respectively.

Thus, a method and system for bridging one or more RF controlled lighting systems has been provided. While the present invention has been described in connection with the exemplary embodiments of the various figures, it is to be understood that other similar embodiments may be used or modifications and additions may be made to the described embodiment for performing the same function of the present invention without deviating therefrom. For example, one skilled in the art will recognize that the present invention as described in the present application may apply to any type of electronic devices that are wirelessly communicating on the same RF, and need not be limited to a lighting application. Therefore, the present invention should not be limited to any single embodiment, but rather should be construed in breadth and scope in accordance with the appended claims.

What is claimed:

1. A wireless lighting control system, wherein all wireless transmissions are on the same Radio Frequency (RF), the system comprising:

a first lighting control subnet operatively connected to a first lighting device;

a second lighting control subnet operatively connected to a second lighting device; and a bridge in wireless and operative communications with the first and second lighting control subnets and the first and second lighting control devices, wherein said bridge transmits a link claim to the first and second lighting control subnets after waiting for a backoff time after the RE signal has ended, transmits a command to the first lighting control subnet with respect to the first lighting device, assigns a random wait time to said first lighting control subnet, and assigns a maximum random wait time to said second lighting control subnet, and receives an acknowledgement from said first lighting control subnet.

2. The system of claim 1, wherein the bridge receives a RF signal from said first lighting control subnet.

3. The system of claim 2, wherein the RF signal comprises a lighting scene identifier associated with a lighting scene stored in the bridge.

4. The system of claim 3, wherein the RF signal comprises a lighting command associated with a lighting scene, and wherein the bridge determines the lighting scene associated with the lighting command.

5. The system of claim 3, wherein the RF signal is responsive to a button press on a master control in said first lighting control subnet.

6. The system of claim 1, wherein said bridge further comprises a display, wherein said display indicates a status of the first and second lighting devices according to the command.

7. The system of claim 6, wherein the display is a LCD screen.

8. The system of claim 6, wherein the display is a LED display.

9. The system of claim 1, wherein said first lighting control subnet comprises a master control.

10. The system of claim 9, wherein said master control comprises an indicator, wherein said indicator displays a status of the first lighting device according to the command.

11. The system of claim 10, wherein the indicator is a LED display.

12. The system of claim 10, wherein the indicator is a LCD screen.

13. The system of claim 1, wherein said first lighting control subnet comprises a lighting control device.

14. The system of claim 13, wherein the lighting control device is a dimmer.

15. The system of claim 1, wherein the bridge further transmits a second link claim to said first and second lighting control subnets, transmits a second command to said first lighting control subnet with respect to the first lighting device, assigns a second random wait time to said first lighting control subnet, and assigns a second maximum random wait time to said second lighting control subnet, and receives a second acknowledgement from said first lighting control subnet.

16. The system of claim 1, wherein the bridge further transmits a second link claim to said first and second lighting control subnets, transmits a third link claim to said first lighting control subnet, transmits a second command to said second lighting control subnet with respect to the second lighting device, assigns a second random wait time to said second lighting control subnet, and assigns a second maximum random wait time to said first lighting control subnet, and receives a second acknowledgement from said second lighting control subnet.

17. The system of claim 1, wherein the bridge is operatively connected to an external device.

18. The system of claim 17, wherein the bridge is operatively connected to the external device by way of an RS-232 connection.

19. The system of claim 17, wherein the bridge receives time information from the external device, determines when a sunrise and sunset time will occur based on a location of the bridge, and transmits the link claim relative to the sunrise and sunset times.

20. The system of claim 17, wherein the bridge receives time information from the external device and transmits the link claim in response to received time information.

21. The system of claim 17, wherein the bridge transmits the link claim in response to an alarm received from the external device.

22. A method for operatively interconnecting a first and second lighting control subnet, wherein each subnet operates at the same RF, comprising:

(a) transmitting a link claim to the first and second lighting control subnets from a bridge, wherein the link claim directs the first and second lighting control subnets to wait for a lighting control command;

(b) transmitting the lighting control command to the first lighting control subnet;

(c) assigning a random wait time to the first lighting control subnet;

(d) assigning a maximum random wait time to the second lighting control subnet; and (e) receiving an acknowledgement from the first lighting control subnet.

23. The method of claim 22, further comprising executing step (a) in response to a button press on the bridge.

24. The method of claim 22, further comprising executing step (a) in response to receiving a RF signal transmitted by a master control of the first lighting control subnet.

25. The method of claim 24, further comprising waiting for a random backoff time before executing step (a).

26. The method of claim 24, wherein the RF signal is transmitted by the master control in response to a button press.

27. The method of claim 24, wherein the RF signal comprises a lighting scene identifier associated with a phantom button stored on the bridge.

28. The method of claim 24, wherein the RF signal comprises a second lighting control command associated with a lighting scene.

29. The method of claim 28, further comprising determining a phantom button associated with the lighting scene according to the lighting control command.

30. The method of claim 22, further comprising repeating steps (a)–(d).

31. The method of claim 22, further comprising displaying, on the bridge, a status of each subnet according to the acknowledgement.

32. The method of claim 31, wherein displaying a status comprises illuminating a LED.

33. The method of claim 22, further comprising:

(t) transmitting a second link claim to the first and second lighting control subnets;

(g) transmitting a second lighting control command to the first lighting control subnet;

(h) assigning a second random wait time to the first lighting control subnet;

(i) assigning a second maximum random wait time to the second lighting control subnet; and (j) receiving a second acknowledgement from the first lighting control subnet.

34. The method of claim 22, further comprising:

(f) transmitting a second link claim to the first and second lighting control subnets;

(g) transmitting a third link claim to the first lighting control subnet;

(h) transmitting a second lighting control command to the second lighting control subnet;

(i) assigning a second random wait time to the second lighting control subnet;

(j) assigning a second maximum random wait time to the first lighting control subnet; and (k) receiving a second acknowledgement from the second lighting control subnet.

35. The method of claim 22, further comprising receiving time information; determining, based on stored information and the received time information, a sunset and sunrise time; and executing step (a) in response to said determination.

36. The system of claim 22, further comprising receiving time information and executing step (a) in response to said time information.

37. The method of claim 22, further comprising executing step (a) in response to an alarm condition received by the bridge.

* * * * *

UNITED STATES PATENT AND TRADEMARK OFFICE

CERTIFICATE OF CORRECTION

PATENT NO. : 6,927,547 B2 
DATED : August 9, 2005
INVENTOR(S) : Robert Francis Walko, Jr. et al.

It is certified that error appears in the above-identified patent and that said Letters Patent is hereby corrected as shown below:

Column 15,
Line 56, "the RE signal" should read -- the RF signal --.

Signed and Sealed this

Twenty-eighth Day of February, 2006

JON W. DUDAS
*Director of the United States Patent and Trademark Office*